United States Patent [19]

Featherstone et al.

[11] 4,192,675

[45] Mar. 11, 1980

[54] PROCESS FOR DECARBURIZING FERRO-MANGANESE

[75] Inventors: Robert A. Featherstone, Northcliff; Paul P. Roos, Florida; Willem A. Gericke, Meyerton, all of South Africa; Jean Saleil, Saint-Etienne, France; Pierre J. Leroy, Saint-Germain-en-Laye, France; Jean-Marcel Masson, Saint-Etienne, France

[73] Assignees: S.A. Manganese Amcor Ltd., Johannesburg, South Africa; Creusot-Loire, Paris, France

[21] Appl. No.: 974,507

[22] Filed: Dec. 28, 1978

[30] Foreign Application Priority Data

Jan. 17, 1978 [FR] France ..... 78 01171

[51] Int. Cl.[2] ..... C21C 5/34

[52] U.S. Cl. ..... 75/60; 75/59

[58] Field of Search ..... 75/59, 60

[56] References Cited

U.S. PATENT DOCUMENTS

| | | | |
|---|---|---|---|
| 3,330,645 | 7/1967 | DeMoustier | 75/60 |
| 3,706,549 | 12/1972 | Knuppel | 75/60 |
| 3,751,242 | 8/1973 | Knuppel | 75/60 |
| 3,990,888 | 11/1976 | Eriksson | 75/60 |
| 4,021,233 | 5/1977 | Johnson | 75/60 |

*Primary Examiner*—P. D. Rosenberg

*Attorney, Agent, or Firm*—Haseltine, Lake & Waters

[57] ABSTRACT

Ferro-manganese is decarburized from a carbon content of as high as 7.5% down to 2% or less by blowing an oxidizing gas into the melt in two stages through one or more immersed tuyeres protected with a peripheral fluid introduced into said tuyeres, utilizing temperatures between 1650° and 1750° C.

14 Claims, No Drawings

PROCESS FOR DECARBURIZING FERRO-MANGANESE

SUMMARY OF THE INVENTION

The present invention is concerned with a process for decarburizing ferro-manganese having a high content of carbon, so-called "carburized" ferro-manganese, in order to obtain ferro-manganese having a lower content of carbon, so-called "refined ferro-manganese".

It is well known to refine baths of pig iron and steel in converters provided with tuyeres which are protected from attack by a surrounding stream of protection fluid. Such metallurgical operations are rapid and thus give good productivity and a very competitive cost. Such processes have not previously been applied to the refining of ferro-manganese. In oxidative refining, the treatment of ferro-manganese presents two specific difficulties:

(a) the loss of a sizeable part of the manganese into the slag, as a result of preferential oxidation of the manganese with respect to oxidation of the carbon, and (b) the loss of a substantial part of the manganese by volatilization during blowing as manganese is a relatively volatile element.

It has been found that in order to favor decarburization rather than oxidation, of the manganese, it is necessary to heat the bath to the maximum possible temperature, whilst to reduce the volatilization of the manganese, it is necessary to heat the bath to the lowest possible temperature.

We have now developed a process for the oxidative decarburization of ferro-manganese which represses the two disadvantages mentioned above sufficiently for the process to become competitive.

According to the present invention, we provide a process for decarburizing a ferro-manganese melt from a carbon content of as high as 7.5% down to 2% or less by blowing an oxidizing gas into the melt in two stages through one or more immersed tuyeres protected with a peripheral fluid introduced into said tuyeres, utilizing temperatures between 1650° and 1750° C.

DETAILED DESCRIPTION

The process of the invention comprises the successive steps of:

(a) blowing pure oxygen to reduce the carbon content from an initial value, $C_1$, of from 6 to 7.5% to a second value, $C_2$, of from 2% to 3.5% and to raise the melt to a temperature of from 1650° to 1750° C., and (b) blowing an oxidizing gas consisting of 0 to 50% of oxygen, at least 30% of steam, and 0 to 70% of an inert gas, all by volume, said gases being blown as a mixture or separately, to reduce the carbon content from the second value, $C_2$, to a third value, $C_3$, which is at most 1.6% and to maintain the temperature of the melt at from 1650° to 1720° C.

In step (a), the melt is preferably raised to a temperature of from 1670° to 1710° C.

Where a final carbon content of less than 1.2% is required, an advantageous option is as follows: the melt is blown with an oxidizing gas consisting of 0 to 25% of oxygen from 30 to 50% of steam, and from 30 to 70% of an inert gas, all by volume, said gases being blown as a mixture or separately, to reduce further the carbon content from the value $C_3$ and to maintain the temperature of the melt at from 1660° to 1720° C.

It is conventional in oxidative blowing decarburization processes to protect the tuyere (s) from attack by providing a surrounding stream of protective fluid (liquid or gas). If this procedure is used, the protective fluid used in steps (a) and (b) may or may not be such as to introduce carbon into the melt, but the protective fluid used in the option hereabove described for low carbon contents must not be such as to introduce carbon into the melt.

When steps (a) and (b) are completed, the melt may, if desired, be subjected to dehydrogenation by blowing with an inert gas, such as argon or nitrogen.

On completion of decarburization, it is desirable to recover some of the manganese which is present in the slag as manganese oxide. One way of doing this is to add one or more reducing components, such as ferro-silicon or silico-manganese, to the slag and then to blow the melt with an inert gas such as argon or nitrogen so as to liquefy the slag and reduce manganese oxides present therein to manganese.

Another way of recovering manganese is to add silica, alumina or calcium fluoride to the slag in order to liquefy it, decant off the liquefied slag and pass it to a reduction furnace wherein the manganese oxides present in the slag are reduced to manganese and the latter recovered.

When it is desired to obtain a nitrided refined ferro-manganese, the inert gas used in step (b) and/or in the dehydrogenation step mentioned above, should be nitrogen, the amount of nitrogen used being such as to give the desired nitrogen content in the final ferro-manganese.

If desired, controlled additions of manganese minerals, such as pyrolusite, or pellets made with manganese oxide-containing dust collected by dedusting converter fumes, may be introduced through the mouth of the refining converter during step (a). In this way relatively cheap manganese oxide can be introduced into the slag and can be at least partially reduced during the first step by virtue of the reduction potential of the melt which is relatively rich in carbon at that moment.

Following completion of decarburization, the final slag may, if desired, not be removed and a fresh charge of ferro-manganese to be decarburized is introduced into the converter, reduction of the manganese oxide present in the slag from the previous charge being effected in carrying out step (a) on the fresh charge.

As will be understood, the advantages of the invention arise from being able to use simultaneously, and in the metallurgically optimum proportions at any instant:

- oxygen as an oxidizing and heating gas,
- steam as an oxidizing and cooling gas which also, as a result of the hydrogen resulting from its decomposition, has a diluting effect on the carbon monoxide hence favoring the decarburization of the melt relative to the oxidation of the manganese,
- an inert gas, for example nitrogen or argon, to dilute the carbon monoxide, but without cooling the melt as much as the steam does, and
- a surrounding protective fluid which protects the blowing nozzle (s) against wear.

Accordingly, in the process according to the invention the following different effects are, in effect, quite distinct: oxidation—heating—cooling—dilution of the carbon monoxide—protection of the nozzles. And it is possible to vary one of them without disturbing the others. Thus, for example, at a bath temperature of less than 1,700° C., an increase in the amount of steam enables a possible rise in temperature, with concommitant volatilization of the manganese, to be reduced or prevented. Steam therefore plays a fundamental role in step (b) as a thermal regulator and hence as a moderator of the volatilization of the manganese.

Conversely, if, during step (b), the temperature of the melt is too low and it is therefore necessary to reduce the supply of steam, it is nevertheless possible to maintain the dilution of the carbon monoxide so as to avoid excessive scorification of the manganese, by increasing the supply of inert gas in accordance with the reduction in the supply of steam.

In order that the invention should be more fully understood, the following example, in which all percentages are by weight unless otherwise specified, is given by way of illustration only:

EXAMPLE

A converter having a capacity of 6 tons, the bottom of which was provided with 2 vertical tuyeres each consisting of 3 concentric tubes, was charged with 5,340 kg of ferro-manganese containing 78.3% manganese, 6.51% carbon, 0.17% silicon and 14.7% iron, and 100 kg of calcined dolomite, the ferro-manganese being liquid and at a temperature of 1,305° C.

In a first step, (a), pure oxygen was blown through the two inner tubes of each of the two tuyeres, at a rate of 20 $Nm^3$/minute for the two tuyeres until a total of 281 $Nm^3$ had been blown. The two tuyeres were protected against wear by a stream of fuel-oil introduced through each external tube.

At the end of step (a), the melt had the following analysis:

C=2.01%, Mn=81.65%, Si=less than 0.1%, Fe=14.2%, and its temperature was 1,700° C.

The slag had the following analysis:

$SiO_2$=0.57%, CaO=8.35%, $Al_2O_3$=0.15%, MgO=5.7%, total iron=9.35%, total Mn=68.3% (including metal balls dispersed in the slag).

In a second step, (b), pure oxygen was blown through the middle tube of each tuyere at a rate of 6 $Nm^3$/minute for the two tuyeres and steam was blown through the central tube at the rate of 6 Kg/minute, representing 7.5 $Nm^3$/minute for the two tuyeres, until a total of 35 $Nm^3$ of oxygen and 35 kg (or 43.5 $Nm^3$) of steam had been blown.

At the end of step (b) the melt had the following analysis:

C=1.37%, Mn=80.85%, Fe=16.7%, and its temperature was 1,680° C.

The slag had the following analysis:

$SiO_2$=1.32%, CaO=7.6%, $Al_2O_3$=0.21%, MgO=10.5%, total iron=9.45%, total Mn=64.4% (including metal balls dispersed in the slag).

To the melt were then added 130 kg of 75% ferro-silicon and 130 kg of lime, while blowing 6 $Nm^3$ of argon per minute through the melt until a total of 30 $Nm^3$ of argon had been blown therethrough.

4,770 kg of ferro-manganese were obtained, of the following analysis:

C=1.33%, Mn=81.05%, Si=0.77%, Fe=16.6%, whilst the analysis of the slag was $SiO_2$=24.4%, CaO=29.0%, $Al_2O_3$=0.77%, MgO=9.5%, total iron=1.8%, total Mn=29.85%.

Metal which had been deposited around the mouth of the converter, known as "mouth skull", was recovered in an amount of about 100 kg.

Overall, the yield of refined ferro-manganese was 88.2% and the yield of manganese amounted to 91.47%.

Of course, these yields could be improved slightly if converters of larger capacity were to be used.

The consumption of fuel-oil to protect the two tuyeres amounted to 29 liters, representing 6.1 liters per ton of ferro-manganese refined. Here again, the consumption of fuel-oil per ton produced would drop significantly with converters of larger capacity.

We claim:

1. A process for decarburizing a ferro-manganese melt by blowing an oxidizing gas into the melt through at least one immersed tuyere protected with a peripheral fluid introduced into the outer tube of said tuyere, and then into said melt, which comprises the successive steps of (a) blowing an oxidizing gas consisting of pure oxygen through an inner tube of said tuyere to reduce the carbon content from an initial value, $C_1$, of from 6% to 7.5% to a second value, $C_2$, of from 2% to 3.5% and to raise the melt to a temperature of from 1650° to 1750° C., and (b) blowing an oxidizing gas consisting of 0 to 50% of oxygen, at least 30% of steam, and 0 to 70% of an inert gas, all by volume through an inner tube of said tuyere to reduce the carbon content from the second value, $C_2$, to a third value, $C_3$, which is at most 1.6% and to maintain the temperature of the melt at from 1670° C. to 1710° C.

2. The process of claim 1, in which the final temperature of the melt in step (a) is at least 1670° C. and at most 1710° C.

3. The process of claim 1, in which the melt is blown with an oxidizing gas consisting of 0 to 25% of oxygen, from 30 to 50% of steam, and from 30 to 70% of an inert gas, all by volume, through an inner tube of said tuyere to reduce further the carbon content to any value under 1.2% and to maintain the temperature of the melt at from 1660° to 1720°.

4. The process of claim 3, wherein, the protective fluid does not introduce carbon into the melt.

5. The process of claim 1 in which steps (a) and (b) are followed by a step in which an inert gas alone is blown through the melt to effect dehydrogenation.

6. The process of claim 1 in which steps (a) and (b) are followed by a step in which at least one reducing component is added to the slag and the melt is blown with an inert gas through an inner tube of said tuyere so as to liquefy the slag and reduce manganese oxides present in the slag to manganese.

7. The process of claim 6 wherein the inert gas group consisting of argon and nitrogen.

8. The process of claim 6, in which the reducing component is selected from the group consisting of ferro-silicon an silico-manganese.

9. The process of claim 1, in which, after steps (a) and (b) a compound selected from the group consisting of silica, alumina and calcium fluoride is added to the slag in order to liquefy it, without reducing it, the liquefied slag is decanted off and passed to a reduction furnace wherein manganese oxide present in the slag is reduced to manganese and the latter recovered.

10. The process of claim 1, in which, after steps (a) and (b), the decarburized ferro-manganese is removed from the converter, leaving the slag, and a fresh charge of ferro-manganese to be decarburized is introduced, reduction of the manganese oxide present in the previous charge slag being effected in carrying out step (a) on the fresh charge.

11. The process of claim 1, in which when an inert gas is blown, it is nitrogen, the amount of nitrogen used being such as to obtain a nitrided refined ferro-manganese having the desired nitrogen content.

12. The process of claim 1, in which controlled addition of a manganese component selected from the group consisting of manganese minerals and manganese oxide-containing pellets is made to the melt during step (a).

13. The process of claim 1 wherein said tuyere is a double tuyere and oxygen and steam are blown together as a mixture in the central tube of said double tuyere.

14. The process of claim 1, wherein said tuyere is a triple tuyere and oxygen is blown through one inner tube and steam is blown separately through the other inner tube of said triple tuyere.

* * * * *